United States Patent [19]

Werner

[11] 4,354,193

[45] Oct. 12, 1982

[54] COLLAPSIBLE ANTENNA SUPPORT APPARATUS AS WELL AS A KIT FOR AND METHOD OF ASSEMBLING THE APPARATUS

[75] Inventor: William L. Werner, Cupertino, Calif.

[73] Assignee: Granger Associates, Santa Clara, Calif.

[21] Appl. No.: 157,448

[22] Filed: Jun. 9, 1980

[51] Int. Cl.[3] ..... H01Q 3/02

[52] U.S. Cl. ..... 343/882; 343/880

[58] Field of Search ..... 343/880–882, 343/912, 915, 765, 766, 901, 902; 52/116–118

[56] References Cited

U.S. PATENT DOCUMENTS 2,860,342 11/1958 Warnery ..... 343/881

*Primary Examiner*—David K. Moore

*Attorney, Agent, or Firm*—Flehr, Hohbach, Test, Albritton & Herbert

[57] ABSTRACT

A collapsible apparatus for supporting an antenna or other such device at a predetermined orientation with the horizontal is disclosed herein along with a kit for and method of assembling the apparatus. This apparatus is made up of a number of straight structural members interconnected in a specific way to form a matrix which is movable between a first collapsed position and a second extended position. In this way, with the matrix in its collapsed position, an antenna can be assembled and mounted thereto and thereafter raised to a higher location by moving the matrix to its extended position. When the particular matrix disclosed herein is in its extended position it is combined with three additional structural members to form an octahedron pair for supporting the assembled and mounted antenna.

11 Claims, 12 Drawing Figures

COLLAPSIBLE ANTENNA SUPPORT APPARATUS AS WELL AS A KIT FOR AND METHOD OF ASSEMBLING THE APPARATUS

The present invention relates generally to a support apparatus for antennas or other devices for support at relatively high elevations and more particularly to a specific type of collapsible antenna support apparatus, preferably in kit form, and method of operating the apparatus which allows an antenna to be assembled and mounted to the apparatus at a relatively low and easily accessible level, for example ground level, and thereafter supported by the apparatus at a substantially higher position.

Presently, there are a number of ways to mount and support antennas at relatively high positions above ground or above like support structures such as roof tops. One way, of course, is to first build the support structure and thereafter assemble the antenna onto its top end. Obviously, this can be complicated, time consuming and expensive, especially if the support structure is relatively tall. Another way of accomplishing this as previously suggested in the prior art is to provide a telescoping type of support structure which is movable vertically between a collapsed position during which time the antenna is assembled and mounted thereto and a raised position causing the assembled and mounted antenna to be elevated into its operating position. So long as the antenna itself is relative short and its operating position is relatively close to the support surface, for example ground, a telescopic type of support apparatus may be satisfactory. However, if the antenna itself is quite tall and if it is to be operated a relatively large distance above its support surface, individual sections making up the telescoping apparatus must themselves be relatively long to provide adequate support. Therefore, even when an apparatus of this type is in its collapsed position, its antenna mounting top end is generally not low enough to be readily accessible for mounting an antenna thereto, especially a tall antenna.

Another previously suggested approach overcomes the drawback just recited by providing a support structure which is pivotally mounted between a fallen position, that is, one where the structure extends horizontally on its support surface, and a vertically extending, erected position. With the structure in its fallen position, an antenna can be readily assembled and mounted to its top end at a low and accessible position and thereafter raised to a higher operating position by raising the structure. In this approach, the antenna is assembled and remains at all times in its operating position. There are a number of drawbacks with this approach. First, the structure itself takes up a large amount of space in its fallen position. Second, a relatively complicated pivoting mechanism is required to support the antenna in its upright position as the latter is moved from its lowered assembled position to its elevated operating position. Third, a rather powerful mechanism is required to raise the support structure and antenna to their elevated positions.

In view of the foregoing, an object of the present invention is to provide an antenna support apparatus, preferably in kit form, and method of assembling the apparatus without the disadvantages associated with the various prior art approaches discussed above.

A more specific object of the present invention is to provide a collapsible antenna support apparatus which is readily movable between a collapsed position relatively close to its support surface, for example ground level, in order to assemble and mount an antenna thereto and an extended position for raising the mounted antenna to a relatively high operating location.

Another specific object of the present invention is to provide a collapsible antenna support apparatus of the type just recited and particularly one which does not require (1) as much support surface during assembly of its associated antenna, (2) a complicated pivot mechanism for connection with its antenna, and (3) as powerful a mechanism for moving from a lowered to a raised position as the previously described prior art support structure which pivots between a fallen position and an erect position.

Still another specific object of the present invention is to provide an antenna support apparatus of the type just recited and particularly one which when in its extended position forms two adjacent octahedrons, hereinafter referred to as an "octahedron pair".

Yet another specific object of the present invention is to provide an antenna support apparatus of the type just recited and particularly one which is capable of raising and lowering its support antenna in a highly stable fashion.

As will be seen hereinafter, the collapsible support apparatus disclosed is one which includes a plurality of straight structural members and means for supporting the latter so as to form a support matrix which has a base end adapted for mounting to the ground or a like support surface and which is movable between a first collapsed position and a second extended position relative to its base end. This apparatus also includes means for moving the matrix between these positions and means adapted for connection with a device to be supported, an antenna in a specific embodiment, for supporting the latter at a predetermined orientation with the horizontal. This latter antenna support means is connected with the matrix of structural members for vertical movement between a lowered position and a raised position relative to the base end of the matrix as the latter moves between its collapsed and extended positions such that the antenna remains at its predetermined orientation throughout its vertical movement.

In a preferred embodiment, the apparatus just described is initially provided in kit form and, when assembled and maintained in its antenna supporting extended position, the matrix of structural members and three additional structural members also comprising part of the apparatus together form an octahedron pair.

The collapsible apparatus as well as its method of assembly and operation will be discussed in more detail hereinafter in conjunction with the drawings wherein.

Figure 1:
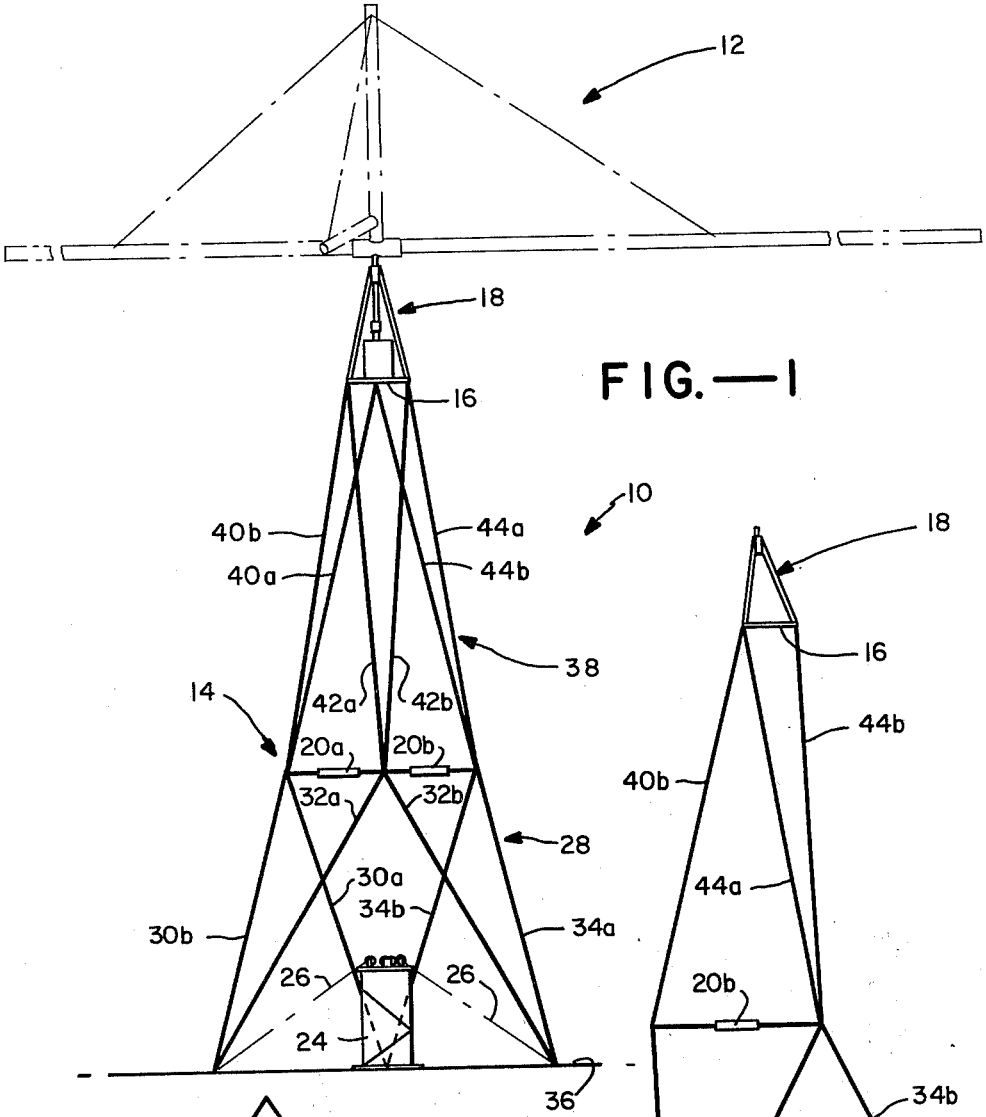
FIG. 1 is a front elevational view of an antenna support apparatus designed in accordance with a preferred embodiment of the present invention and shown in its antenna supporting, extended position.
Figure 2:
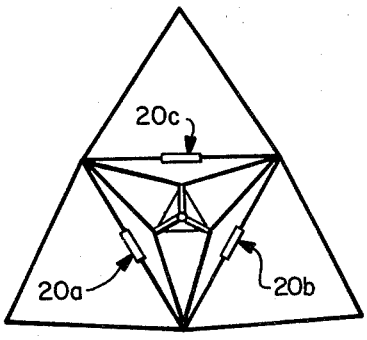
FIG. 2 is a top plan view of the antenna support apparatus as shown in FIG. 1.
Figure 3:
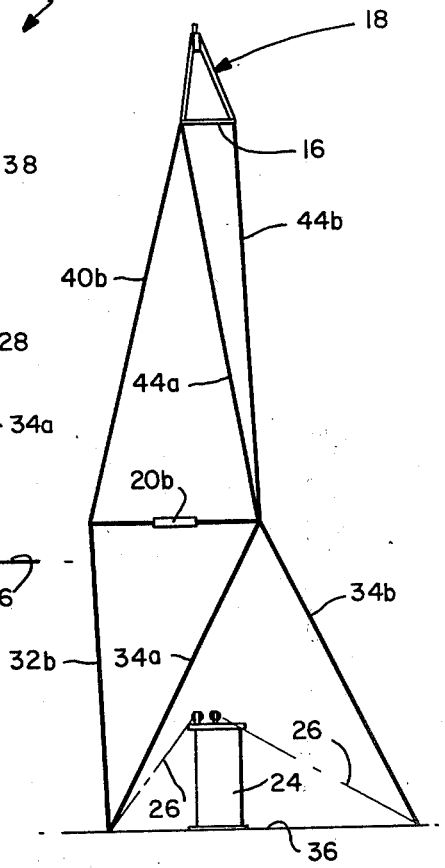
FIG. 3 is a side elevational view of the antenna support apparatus as shown in FIG. 1.

Turning now to the drawings, wherein like components are designated by like reference numerals throughout the various figures, attention is first directed to FIGS. 1–3 which illustrate a collapsible antenna support apparatus which is designed in accordance with the present invention and which is generally designated by the reference numeral 10. Apparatus 10 is shown in these figures in its antenna supporting, extended or erected position and is preferably free-standing. In FIG. 1, an assembled antenna 12 is shown mounted on top of apparatus 10. The particular antenna, illustrated is a Model 2004 ANTENNA manufactured by Granger Associates, Inc. of California. However, as will become apparent hereinafter, apparatus 10 is capable of supporting all sorts of antennas including, for example, a parabolic dish type of antenna or other devices. For purposes of clarity, the antenna 12 is shown only in FIG. 1. Moreover, while apparatus 10 will be described hereinafter as supporting an antenna, it is to be understood that the present invention is equally applicable to these other devices.

As discussed previously and as will be seen in more detail hereinafter, antenna support apparatus 10 includes as its primary components a number of straight structural members which are interconnected to form a tapering matrix which is movable between a collapsed position (to be discussed hereinafter) and the extended position shown in FIGS. 1, 2 and 3. As seen in these latter figures, the antenna support apparatus is shown also including an uppermost horizontal top plate or built-up structure 16 fixedly mounted to the top of matrix 14 and a fixed tripod type of structure 18 mounted on the support plate. In addition, three horizontally extending structural members 20*a*, 20*b* and 20*c* are shown interconnected with and extending across matrix 14 intermediate to its base or bottom end and its top end. These horizontal members and the matrix together form an "octahedron pair", that is, two adjacent octahedrons which taper inwardly. This is the reason for the rather irregular shape of the overall apparatus as seen in FIG. 2. As shown in FIG. 1 only, antenna 12 is supported by tripod structure 18 and support plate 16 for rotation. In this regard, a motor or other suitable means generally indicated at 22 may be provided within the tripod structure on plate 16 for rotating the antenna.

As stated above, matrix 14 is movable between the position shown in FIGS. 1–3 and a collapsed position. As will be seen hereinafter, when the matrix is in its collapsed position, the support plate 16 rests on the top of a fixed pedestal 24 which is maintained centrally within the matrix and held in place at its base by suitable means (not shown) and by a plurality of guy wires 26 extending from the top of the pedestal outwardly and downwardly to the base of the matrix. While not shown in FIGS. 1–3, the overall antenna support apparatus includes an arrangement of pulleys and ropes for moving matrix 14 between its collapsed and extended positions. As will also be seen hereinafter, during this movement, support plate 16 remains horizontal while moving vertically between a lowered position and a raised position so that antenna 12 remains at the orientation shown in FIG. 1 throughout this movement.

Having described the antenna support apparatus generally, attention is now directed to the various components making up matrix 14 and the way the latter is moved between its collapsed and extended positions. At the outset, it should be noted that the various structural members making up the matrix are straight tubular members in a preferred embodiment, preferably steel tubes. As seen best in FIGS. 1 and 2 in conjunction with FIG. 4, this matrix of structural members is made up a bottom arrangement 28 of three A-frames, each of which is formed of two of the structural members, specifically members 30*a*, 30*b*; 32*a*, 32*b* and 34*a*, 34*b*, respectively. Each of these A-frames defines an apex at the joined end of its structural members and a base at its spaced ends. As seen best in FIGS. 1 and 3, the base ends of these A-frames are located in a common fixed horizontal plane, specifically on a support surface for apparatus 10, for example, ground level generally indicated at 36. Matrix 14 also includes a top arrangement 38 of three A-frames, each of which is formed of two of the structural members, specifically members 40*a*, 40*b*; 42*a*, 42*b*; and 44*a*, 44*b*, respectively. Like the lower A-frames, each of the top A-frames defines an apex at the connected ends of the structural members and a base at their space ends.

As will be described in more detail hereinafter, the base of each of the top A-frames is pivotally connected by suitable means with previously described horizontal support plate 16 and, hence, lies in the horizontal plane of the support plate which, as stated previously, is movable vertically as matrix 14 moves between its collapsed and extended positions. As will also be described hereinafter, means are provided for pivotally supporting the base of each of the bottom A-frames about a pivot axis in the fixed plane 36, that is, to ground level or whatever other support surface is provided. In addition means are provided for pivotally connecting together the apex of each of the bottom A-frames with the apex of a vertically aligned, associated top A-frame. The first of these means will be discussed with respect to FIG. 10, the second with FIG. 6 and the third with FIG. 7.

Figure 6:
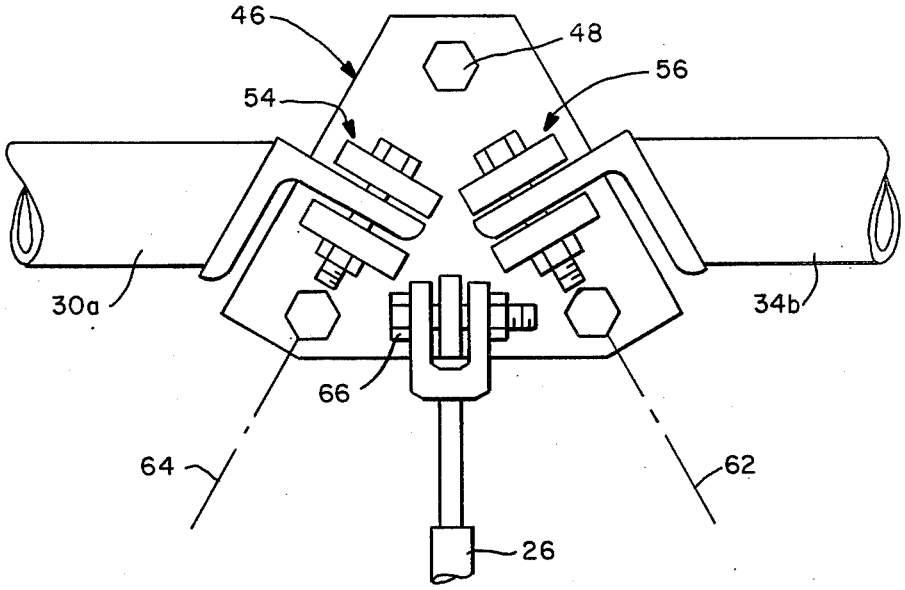
FIG. 6 is an enlarged view illustrating a detailed aspect of the antenna support apparatus of FIG. 4, taken generally along line 6—6 in FIG. 4.

Referring now to FIG. 6 in conjunction with FIG. 4, the way in which the base of each bottom A-frame is pivotally connected to a fixed surface, i.e. surface 36, will be described. In this regard, FIG. 6 illustrates a support pad 46 which is mounted to support surface 36 by bolts 48 or other suitable fastening means. As seen best in FIG. 4, pad 46 is appropriately positioned to support the bottom ends of structural members 30*a* and 34*b*. Similar pads 50 and 52 are mounted to surface 36 and appropriately positioned for pivotally supporting the bottom ends of structural members 30*b*, 32*a* and 32*b*, 34*a*, respectively, in the same manner as pad 46, although only this latter pad and the way it supports its structural members will be described in detail. In this regard, as seen in FIG. 6, the pad 46 includes two hinge mechanisms 54 and 56, each of which is comprised of two confronting but spaced apart upstanding flanges fixedly connected to pad 46 and a bolt extending through the flanges and held in place by a nut. A bottom end of each of the structural members 30*a* and 34*b* includes a welded or otherwise suitably connected angle bracket 58 and 60, respectively, having its outwardly projecting sides mounted for pivotal movement to an associated hinge mechanism, as illustrated. In like manner, the bottom ends of structural members 30*b* and 32*a* are pivotally connected with associated hinge mechanism mounted to pad 50 and the bottom ends of structural members 32*b* and 34*a* are pivotally mounted with associated hinge mechanisms to pad 52. In this way, the A-frame 34*a*, 34*b* uses the pads 46 and 52 in order to pivot about the hinge line 62 indicated by dotted lines in FIG. 4.

The A-frame 30*a*, 30*b* uses pads 46 and 50 to pivot about dotted hinge line 64 and the A-frame 32*a*, 32*b* uses the pads 50 and 52 for pivoting about the dotted hinge line 65. One of the previously mentioned guy lines 26 which is used to help support pedestal 24 is shown having its bottom end pivotally connected to pad 46 by a suitable hinge mechanism generally indicated at 66. The bottom ends of the other guy wires are similarly attached to pads 50 and 52.

Figures 9, 10, 11, 12:
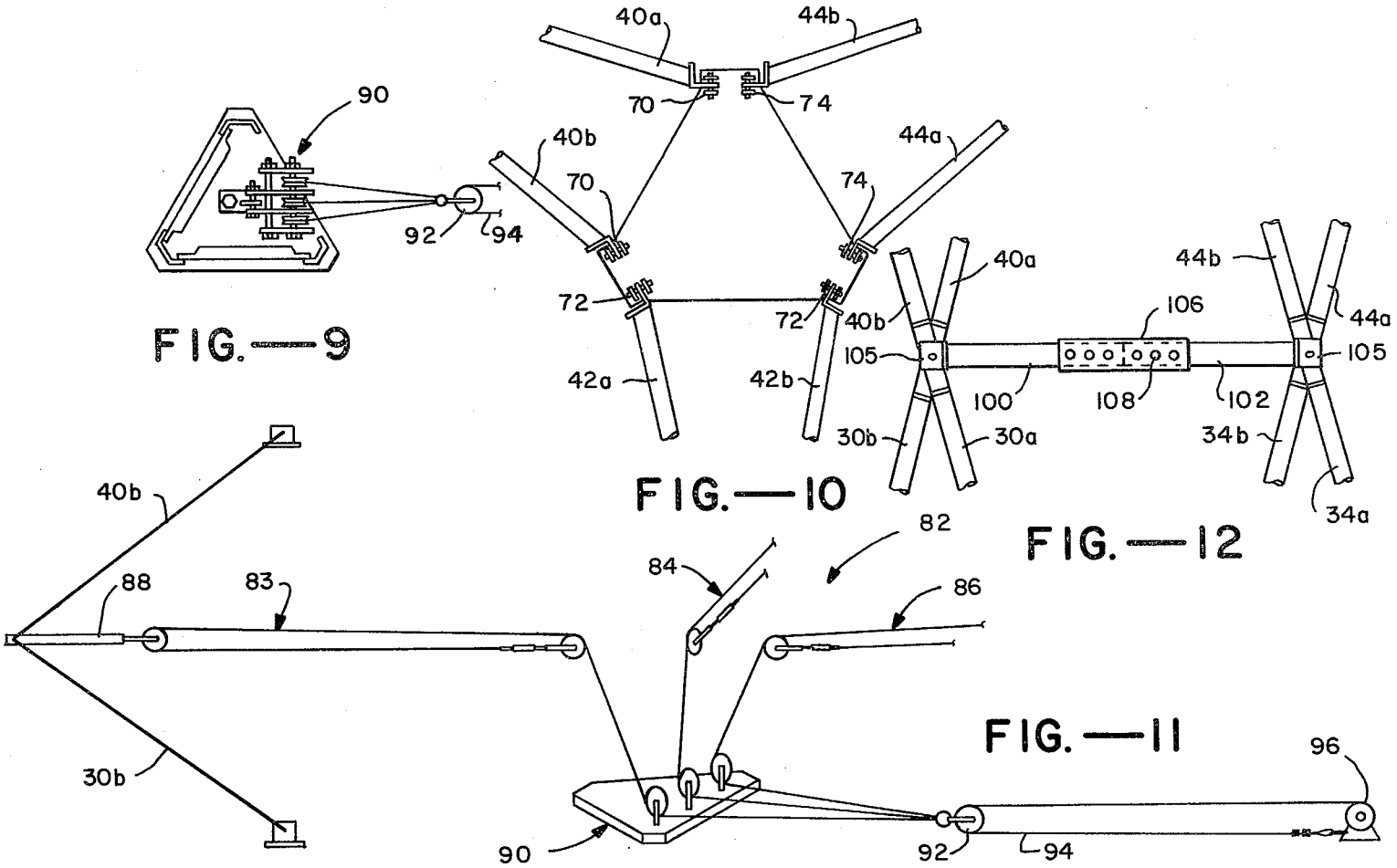
FIG. 9 is an enlarged view of yet another detailed aspect of the antenna support apparatus taken generally along line 9—9 in FIG. 5.
FIG. 10 is an enlarged view of still another detailed aspect of the antenna support apparatus taken generally along line 10—10 in FIG. 5 and rotated 180°.
FIG. 11 is a diagrammatic illustration of yet another detailed aspect of the antenna support apparatus.
FIG. 12 is an enlarged view of yet a final detailed aspect of the antenna support apparatus.

The base of each of the top A-frames is pivotally connected to the underside of previously described support plate 16 in a similar fashion. This is best illustrated in FIG. 10 which shows an underside of the support plate which is somewhat triangular configuration. As seen in FIG. 10, two hinge mechanisms are mounted to the underside of the support plate at each corner thereof. The hinge mechanisms indicated at 70 serve to pivotally support the top ends of structural members 40*a* and 40*b*, the hinge mechanisms 72 serve to pivotally support the top ends of structural members 42*a* and 42*b* and the hinge mechanisms 72 serve to pivotally support the top ends of structural members 44*a* and 44*b*.

As stated previously, the apex of each bottom A-frame making up arrangement 28 (see FIG. 1) is pivotally connected with an associated (vertically aligned) top A-frame making up arrangement 38. Thus, the apex of structural members 30*a*, 30*b* is pivotally connected with the apex of structural members 40*a*, 40*b*, the apex of structural members 32*a*, 32*b* is pivotally connected with the apex of structural members 42*a*, 42*b*, and, finally, the apex of structural members 34*a*, 34*b* is pivotally connected with the apex of structural members 44*a*, 44*b*. One mechanism for accomplishing this is shown in detail in FIG. 7. There, the apex ends of structural members 34*a* and 34*b* are shown including angle brackets 76 welded or otherwise suitably mounted thereto. The angle brackets are also pivotally mounted about a hinge mechanism generally indicated at 77 (see FIG. 8). A pair of elongated, confronting channel members 78 are also pivotally connected at their bottom ends to hinge mechanism 77. The top end of the channel members include cross plates 81 which are welded or otherwise suitably connected to the apex ends of structural members 44*a* and 44*b*.

Figure 7:
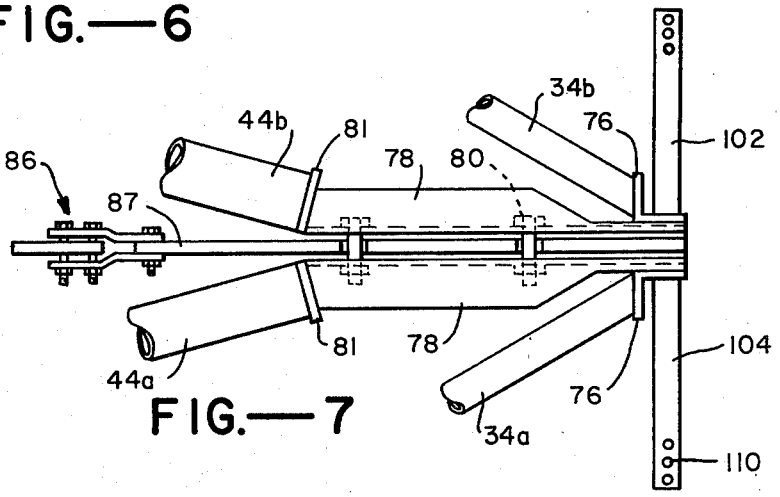
FIG. 7 is an enlarged view of another detailed aspect of the antenna support apparatus, taken generally along line 7—7 in FIG. 5.
Figure 8:
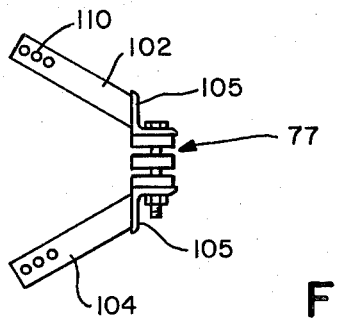
FIG. 8 is a view of still another detailed aspect of the antenna support apparatus, taken generally along line 8—8 in FIG. 7.

Having described the pivoting mechanism between apexes of structural members 34*a*, 34*b* and 44*a*, 44*b* it should be apparent that the pivoting mechanisms of each of the other pairs of joined apexes are identical. In all three cases, other components are present at these joined points as seen in FIGS. 7 and 8. These other components will be discussed hereinafter.

Figure 4:
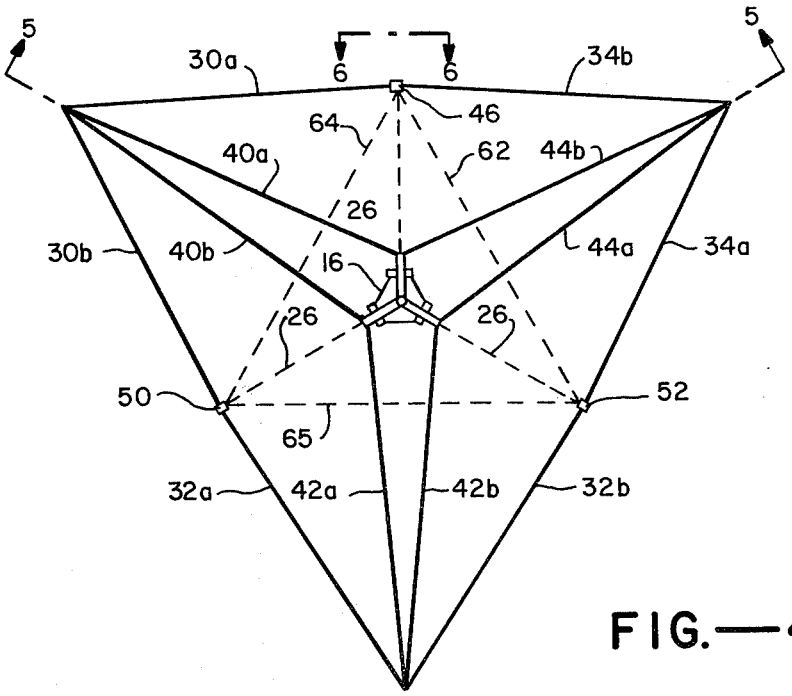
FIG. 4 is a top plan view of the antenna support apparatus of FIGS. 1–3 but shown in its collapsed position.
Figure 5:
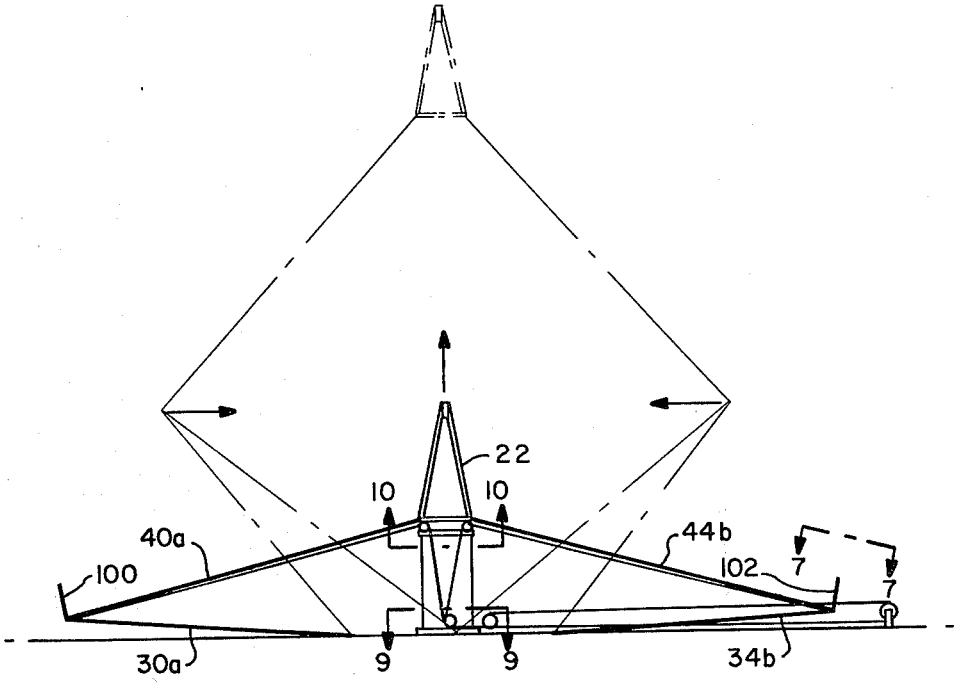
FIG. 5 is a sectional view of the antenna support apparatus illustrated in FIG. 4 and taken generally along line 5—5 in FIG. 4.

Having described how matrix 14 is interconnected together, it should be clear how the matrix moves between the collapsed position shown in FIGS. 4 and 5 and the extended or erected position shown in FIGS. 1–3. It should be equally apparent that as the matrix moves between these positions, support plate 16 moves vertically between a lowermost position shown best in FIG. 5 and an elevated position shown best in FIGS. 1 and 3. During this movement, the support plate remains horizontal and therefore tripod support structure 18 and antenna 12 remain at fixed orientations relative to the horizontal. In actually describing this movement attention is first directed to FIG. 5. There it can be seen that the support plate 16 rests on the top of pedestal 24 when the matrix is collapsed. At the same time, the bottom A-frames and the top A-frames are pivoted downwards and outwards so that their common apexes extend maximum distances from the center of pedestal 24 and quite close to surface 36. As the matrix moves to its extended position, each of the bottom A-frames pivots upward about its hinge line as does each associated top A-frame. At the same time, the joining apexes of these A-frames move inwardly toward one another, as best illustrated by the arrows and the intermediate position of the matrix illustrated by dotted lines in FIG. 5. Eventually the A-frames become approximately vertical, as seen in FIGS. 1 and 3, and there joined apexes are in their maximum inward positions.

From the foregoing, it should be apparent that it is necessary to apply a vertically upward force component on the top A-frames in order to raise the matrix. By positioning the bottom A-frames as close to the horizontal as possible when the matrix is collapsed and maximizing the angle of the top A-frames relative to the horizontal (assuming given A-frame lengths), the vertical components of force applied to the top A-frames can be maximized. This, in turn, can reduce the original force necessary to raise the matrix.

Any suitable mechanism may be provided for actually moving the matrix 14 between its collapsed and extended position. One particular arrangement generally indicated at 82 is shown in FIG. 11 and is best described in conjunction with FIGS. 5, 7 and 9. This arrangement includes a set of pulleys and cables associated with each pair of pivotally connected bottom and top A-frames. One set is shown in FIG. 11 at 83, another set is partially shown in FIG. 11 at 84 and still another set is partially shown in the same figure at 86. The set of cables and pulleys 83 is connected at one end to the matrix at a point adjacent the connected apexes of A-frames including structural members 30*a*, 30*b* and 40*a*, 40*b* by means of a flexible connecting strap 88. Similar straps serve to connect the corresponding ends of sets 84 and 86 to their respective A-frame pairs. The strap associated with set 86 is shown in detail in FIG. 7 at 87. Note that one end is pivotally connected to a pully assembly comprising part of set 36 and its other end is connected around pivot mechanism 77. Also note that the strap is notched to make room for the connecting bolts between channel members 80. A pulley associated with each of the pulley and cable sets is fixedly connected to the top of pedestal 24, as best seen in FIG. 5. Also, all of the cables of the sets pass through a common pulley mechanism 90 which is best seen in FIG. 9. This mechanism is made up of three pulleys mounted to a base plate which, in turn, is fixedly mounted to surface 36. The three sets of cables are joined together at their otherwise free ends by means of a coupling block 92 (a single pulley) best seen in FIG. 11. The coupling block is connected by its own pulley arrangement 94 to a power winch 96.

Having described overall arrangement 80, attention is now directed to the way in which it operates to move matrix 14 between its collapsed and extended positions. This is best described starting with FIG. 11. With the coupling block 92 in its far left-hand position, as viewed in FIG. 11, the matrix is collapsed. As the block is pulled to the right, that is, towards winch 96 by the latter, the connected apexes of the associated bottom and top A-frames are pulled inward toward one another. This causes the A-frames to pivot upward which, in turn, cause the horizontal support plate 16 to move vertically upward while remaining horizontal and quite stable. This movement of a coupling block to the left reverses this process.

Having described matrix 14 and the way the latter is moved between its collapsed and extended or erected position, attention is now directed to the previously recited horizontal structural members 20*a*, 20*b* and 20*c* which form part of the overall antenna support apparatus 10 when the matrix 14 is in its extended position. One of the additional structural members, specifically the member 20*c*, is best illustrated in FIG. 12. As seen there, this member includes two tubular end sections 100 and 102 which are in coaxial relationship to one another and which have adjacent ends in confronting engagement, that is, assuming that matrix 14 is at its full erected position. The other ends of these end sections 100 and 102 are fixedly connected to matrix 14 in close proximity to the apexes of adjacent pairs of bottom and top A-frames, specifically adjacent the apexes defined by the A-frames 30*a*, 30*b* and 40*a*, 40*b* on one side and the A-frames 34*a*, 34*b* and 44*a*, 44*b* on the other side. The way in which these connections are made is best illustrated in FIGS. 7 and 8. There, the end section 102 is shown along with an end section 104 which comprises part of the additional structural member 20*b*. Note that these end sections are welded or otherwise suitably attached to their own angle plates 105 which are pivotally connected with mechanism 77. In FIGS. 7 and 8, the matrix 14 is in its collapsed position. As a result, end sections 102 and 104 and, in fact, all of the end sections making up the three additional structural members extend out at angles, as shown best in FIG. 8 and FIG. 5. However, as the matrix moves to its fully erected position, the associated end sections move into co-axial alignment with one another such that their otherwise free ends engage each other as seen in FIG. 12.

In order to provide ultimate structural members 20*a*, 20*b* and 20*c*, the end sections of each are interconnected together. This is best illustrated in FIG. 12 where an intermediate tubular sleeve 106 is shown comprising part of the overall structural member 20*c*. This sleeve extends around opposing end portions of end sections 100 and 102. The sleeve includes a plurality of through holes 108 which align with corresponding through holes 110 in the end sections (see FIG. 7). In this way a plurality of interlocking keys or cross-bolts (not shown) may be retained in the aligned holes for interlocking the sleeve around the end sections and holding the latter in place. Similar sleeves are shown generally in FIG. 2.

It should be apparent from the foregoing that the sleeve 106 and the other sleeves must be assembled to their associated end sections before the latter come into their final coaxial positions. In actual practice, each sleeve is put on to one of the end sections while there is sufficient space between the associated end sections to allow for this, that is, at an intermediate point in the movement of matrix 14 towards its extended position. Once the sleeves are so assembled, the end sections are brought closer together so that each sleeve slides partially onto both of its end sections. In this way, the sleeves not only act to interlock its two end sections but also as guides to assure that the end sections engage one another in the manner shown in FIG. 12. Once the end sections do engage one another the matrix is in its fully extended or erected position. In this regard, the operator can use the engagement of the end sections as an indication that the matrix is in its erected position and does not have to be concerned with overextending the matrix.

Having described overall antenna support apparatus 10, the components making up this apparatus and the way in which it moves between a collapsed position and an extended position, it should apparent that the apparatus can be reasonably provided in kit form. This kit includes all of the tubular members making up the matrix, e.g. 12 in all, the tubular sections including the intermediate sleeves making up the horizontally extending additional structural members, three members in all (9 sections), as well as the other components making up the apparatus and the hardware necessary for assembling it. A support plate 16 and its associated tripod support structure can be provided in unassembled form and the pedestal can be provided with or without the pulleys on its top surface in kit form. In any event, such a kit can be readily taken to the installation site and assembled together. Once assembled, in order to assemble the selected antenna, the matrix is initially maintained in its collapsed position. In this position, the antenna is assembled at its upright operating orientation. Once this is done, the entire matrix can be raised towards its fully extended position. Just prior to reaching this position, the additional structural members can be assembled, as described previously, and fully interlocked together after the matrix reaches its fully extended position. Should it be desirable to collapse the apparatus, it is only necessary to disassemble the structural members 20*a*, 20*b* and 20*c* first. If it is desirable to collapse the apparatus quickly, for example in response to high winds, the structural members 20*a*, 20*b* and 20*c* could be provided with solenoid type of locking means rather than the keys referred to above. The solenoid interlocking means could be readily actuated electronically by providing an appropriate circuit in combination with some form of wind sensor. Under these conditions, should the wind come up above a predetermined level, it would be sensed and automatically actuate the interlocking means to disassemble structural members 20*a*, 20*b* and 20*c*. At the same time, power for the previously described winch 96 would be provided to lower the apparatus.

Overall apparatus 10 has been described as one made up of a tapering matrix (so that it may be free standing) and additional structural members which together form a tapering octahedron pair, that is, two vertically adjacent octahedrons. It is to be understood that the overall apparatus could include more than two octahedrons by including additional vertically connected matrices 14 and associated additional structural members. Moreover, the present invention not only contemplates a collapsible apparatus as described but also a permanently erected one made up of at least one tapering octahedron pair such that this latter apparatus may be free standing.

What is claimed:

1. A collapsible apparatus for supporting an antenna or other such device at a predetermined orientation with the horizontal, said apparatus comprising: a plurality of straight structural members; means for supporting the ends of said structural members so as to form a support matrix which has a base end adapted for mounting to the ground or a like support structure and which is movable between a first collapsed position and a second extended position relative to its base end; means for moving said matrix between said collapsed and extended positions; and means adapted for connection with said antenna or other such device for supporting the latter, said antenna support means being connected with said matrix of structural members for vertical movement between a lowered position and a raised position relative to said base end as said matrix moves between its collapsed and extended positions such that an antenna or other such device connected to and supported by said support means at said predetermined orientation remains at said orientation throughout said vertical movement; said support matrix including a bottom arrangement of three A-frames, each of which is formed of two of said structural members that together define an apex and base, the latter being located in a specific fixed horizontal plane, and a top arrangement of three A-frames, each of which is formed of two of said structural members that together define an apex and base, the latter being located in a horizontal plane which is vertically movable between a lowered position and a raised position relative to the base end of said matrix as the latter moves between its collapsed and extended position, and wherein said structural member supporting means includes first means for pivotally supporting the base of each of said bottom A-frames about a pivot axis in said fixed plane, second means for pivotally supporting the base of each of said top A-frames about a pivot axis in said vertically movable plane, and third means for pivotally connecting together the apex of each of said bottom A-frames with the apex of a respective one of said top A-frames.

2. An apparatus according to claim 1 wherein the vertical distance between the base end of said matrix and said antenna support means when the latter is in its lowered position is substantially less than the length of any one of said structural members and said distance is substantially greater than any one of said members when said support means is in its raised position.

3. An apparatus according to claim 1 including means forming three additional straight structural members in combination with said matrix when the latter is in its extended position, each of said additional members having opposite ends connected with said matrix at respective points in close proximity to the pivotally connected apexes of associated adjacent pairs of bottom and top A-frames, whereby said matrix and additional members together form an octahedron pair.

4. An apparatus according to claim 3 wherein each of said additional structural members includes separate opposite end sections including said opposite ends, a separate intermediate tubular section sufficiently large to receive the unconnected ends of said end sections and means for fixedly connecting each of said end sections with its tubular section so as to form one of said additional members.

5. A collapsible apparatus for supporting an antenna or other device, said apparatus comprising: a plurality of structural members interconnected together to form a matrix including a plurality of upper and a plurality of lower A-frames having a base end adapted for mounting to the ground or like support structure and an opposite end adapted for connection with an antenna or other device, said matrix being movable between a first collapsed position and a second extended position relative to its base end; means for moving said matrix between said collapsed and extended positions; and means forming additional structural members in combination with and connected to said matrix between said upper and lower A-frame when and only when the matrix is in its approximate extended position such that said extended matrix and said additional members together form an octahedron pair.

6. A collapsible apparatus for supporting an antenna at a predetermined orientation with the horizontal, said apparatus comprising: a first group of interconnected lower structural members and a second group of interconnected upper structural members which together form a matrix having a base end adapted for mounting to the ground or like support structure and an opposite top end adapted to support an antenna; means for pivotally supporting said first and second groups of structural members including to each other such that said position and a laterally contracting position for causing its top end to move vertically between a lowered position and a raised position; means for moving said matrix between said expanded and contracted positions; and means forming additional structural members in combination with said matrix when the latter is in its expanded position to form an octahedron pair, said additional members being connectable with said matrix between said upper and lower groups to form said octahedron only when said matrix is approximately in its expanded position.

7. A kit from which an antenna support apparatus is assembled, said kit comprising: a plurality of structural members adapted for interconnection to form a matrix having a base end adapted for mounting to the ground or like support structure and an opposite end adapted for connection with an antenna, said matrix once assembled being movable between a first collapsed position and a second extended position relative to its base end; means adapted for connection with said matrix once the latter has been assembled for moving said matrix between said collapsed and extended positions; and means forming additional structural members in combination with and adapted for connection to said matrix after and only after the latter is formed and approximately in its extended position such that said matrix and additional members together form an octahedron pair.

8. A kit from which a collapsible antenna support apparatus is assembled, said kit comprising: a plurality of straight structural members; means adapted for connection with said structural members so as to form a support matrix which has a base end adapted for mounting to the ground or like support structure and which is movable between a first collapsed position and a second extended position relative to its base end; means adapted for connection with said matrix once the latter is formed for moving said matrix between said collapsed and extended positions; and means adapted for connection with said antenna for supporting the latter at a predetermined orientation relative to the horizontal, said antenna support means also being adapted for connection with said matrix once the latter has been formed for vertical movement between a lowered position and a raised position relative to the base end of the matrix as the latter moves between its collapsed and extended positions such that an antenna connected to and supported by said support means at a predetermined orientation remains at said orientation throughout said vertical movement; said support matrix once formed including a bottom arrangement of three A-frames, each of which is formed of two of said structural members fit together to define an apex and base, the latter being located in a specific fixed horizontal plane and a top arrangement of three A-frames, each of which is formed of two of said structural members fit together to define an apex and base, the latter being located in a horizontal plane which is vertically movable between a lowered position and a raised position relative to the base end of said matrix as the latter moves between its collapsed and extended position, and wherein said structural member supporting means includes first means adapted for pivotally supporting means includes first means adapted for pivotally supporting the base of each said bottom A-frames about a pivot axis in said first plane, second means for pivotally supporting the base of each of said top A-frames about a pivotal axis in said vertically movable plane, and third means for pivotally connecting together the apex of each of said bottom A-frames with the apex of a respective one of said top A-frames.

9. A kit according to claim 8 including means forming three additional straight structural members in combination with and adapted for connection to said matrix when the latter is formed and in its extended position, each of said additional members having opposite ends adapted for connection with said matrix at respective points in close proximity to the pivotally connected apexes of associated adjacent pairs of bottom and top A-frames, whereby said matrix and additional members better form an octahedron pair.

10. A kit according to claim 9 wherein each of said additional structural members includes opposite end sections and separate intermediate tubular sections sufficiently large to receive said end sections by means for fixedly connecting each of said end sections with its tubular section so as to form one of said additional members.

11. A method of assembling an antenna and supporting it a predetermined distance from a given support surface and at a predetermined orientation with the horizontal, said method comprising the steps of: interconnecting a plurality of straight structural members so as to form a matrix of six A-frames interconnected in a predetermined array which has a base end adapted for mounting to the ground or like support structure and which is movable between a first collapsed position and a second extended position relative to its base end; after forming said matrix, maintaining the latter in its collapsed position; while said matrix is in its collapsed position, assembling and mounting an antenna onto said matrix such that the antenna is at said predetermined orientation with the horizontal; thereafter, moving said matrix from its collapsed position to its extended position such that said assembled and mounted antenna moves vertically from its assembled position to an operating position while at all times maintaining at said predetermined orientation with the horizontal; and thereafter interconnecting three additional elongated members to the matrix approximately when the latter is in its extended position such that additional structural members and the matrix together form an octahedron pair.

* * * * *